United States Patent [19]

Coutre

[11] Patent Number: 4,919,625

[45] Date of Patent: Apr. 24, 1990

[54] TRACK LIGHTING APPARATUS

[75] Inventor: Leonard J. Coutre, Chicago, Ill.

[73] Assignee: Cooper Industries, Inc., Houston, Tex.

[21] Appl. No.: 187,808

[22] Filed: Apr. 29, 1988

[51] Int. Cl.[5] ..... H01R 25/14

[52] U.S. Cl. ..... 439/118; 439/119; 439/210

[58] Field of Search ..... 439/110, 114, 115, 117, 439/118, 119, 207, 208, 210, 212, 213

[56] References Cited

U.S. PATENT DOCUMENTS

| | | | |
|---|---|---|---|
| 3,531,758 | 9/1970 | Blumkin | 439/213 |
| 4,256,357 | 3/1981 | Vasseur et al. | 439/115 |
| 4,676,567 | 6/1987 | Mouchi | 439/207 |

*Primary Examiner*—Eugene F. Desmond

*Attorney, Agent, or Firm*—Alan R. Thiele; Eddie E. Scott; Nelson A. Blish

[57] ABSTRACT

Track lighting apparatus is disclosed which includes a track section, plug box and plug connector designed to incorporate two lighting circuits independently controllable within the same track section. The track section includes a neutral bus and a grounding bus on one lateral side and two independent voltage busses on its other lateral side. The head of the plug box inserted in a bottom slot running the longitudinal length of the track section, may be rotated into position in only one direction, thereby preventing inadvertent connection of neutral and grounding contacts to voltage busses and vice versa. The plug box head has a voltage contact which may be mechanically moved between two positions for alternative connection to either of the voltage busses of the track when the plug head is connected to the track. The plug connectors, one designed for insertion via the right hand end of the track section, the other via the left hand end, are provided to connect two or more track sections together in straight, "L", "T", or "X" patterns, or to provide electrical feed from the wall or ceiling on which the track is installed or to provide track section termination. The plug connectors include a grounding finger to connect the track structure to the grounding bus and includes an inverse L shaped channel in which a connection member is disposed. The connection member includes a lateral contact, a vertical member and a lateral terminal member.

4 Claims, 5 Drawing Sheets

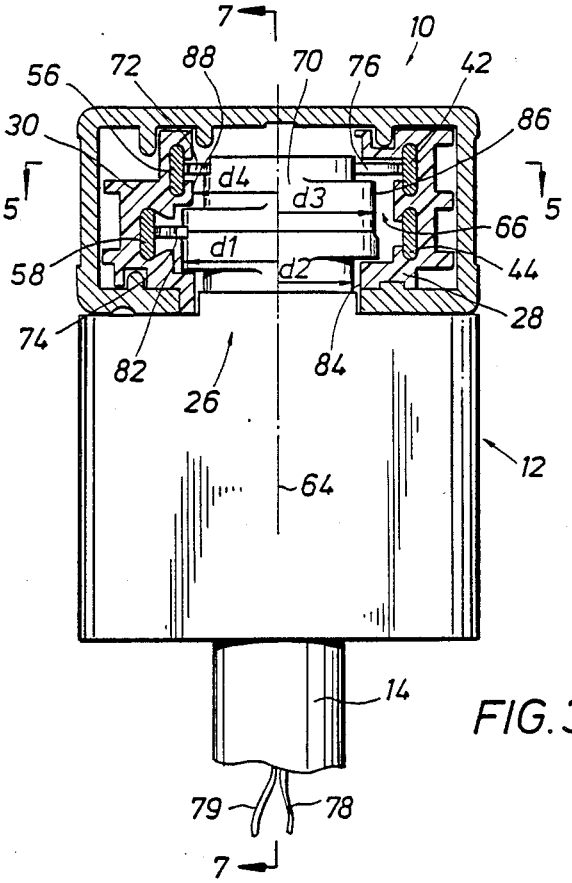
FIG. 3
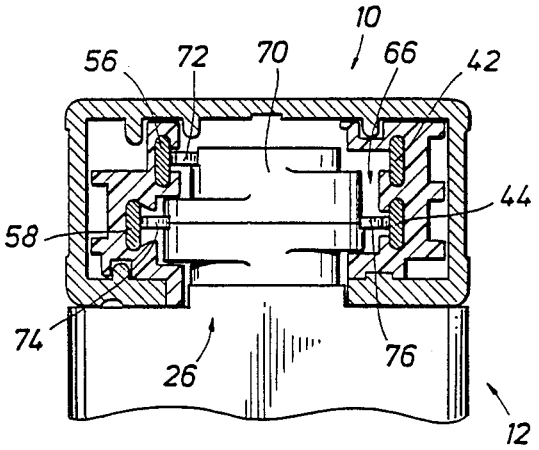
FIG. 4
FIG. 6
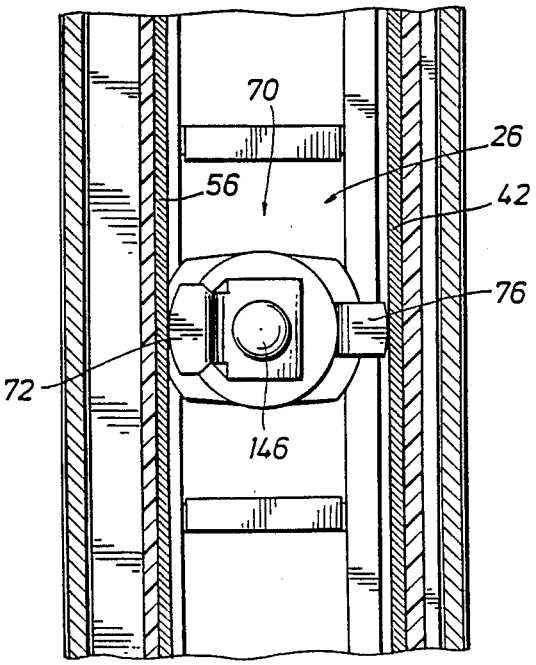
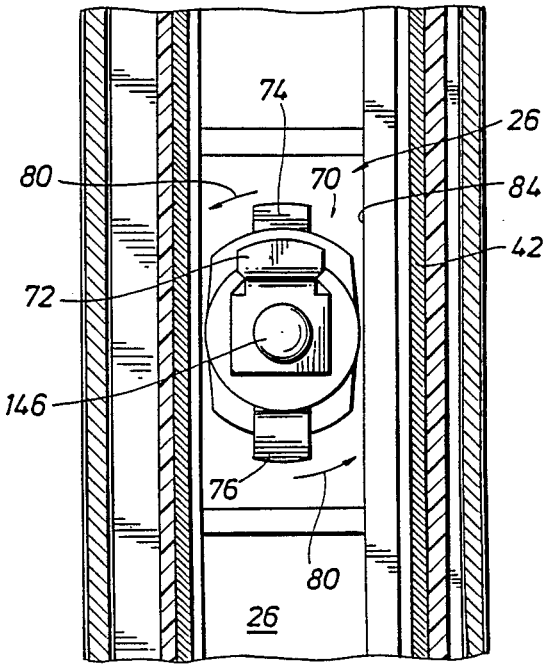
FIG. 5

FIG.7
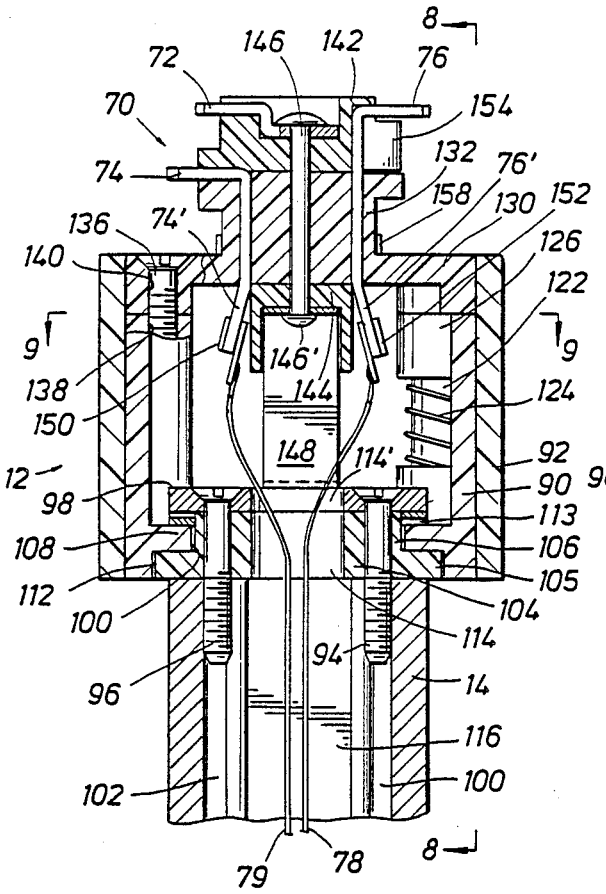
FIG.8
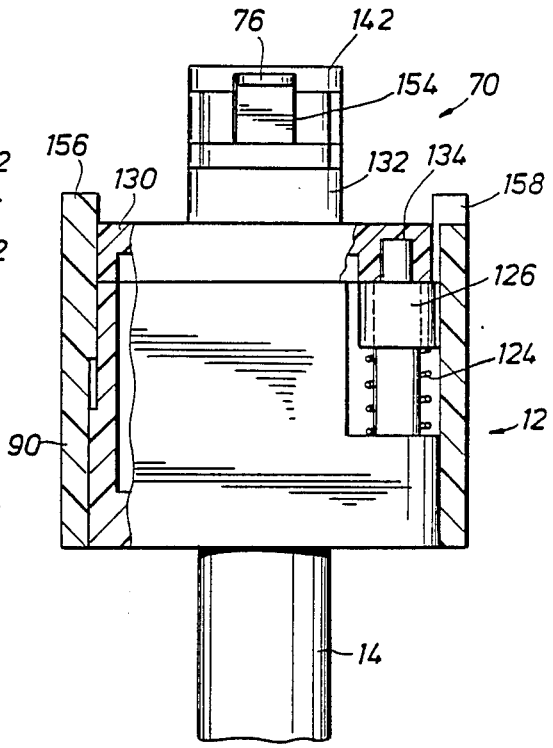
FIG.9
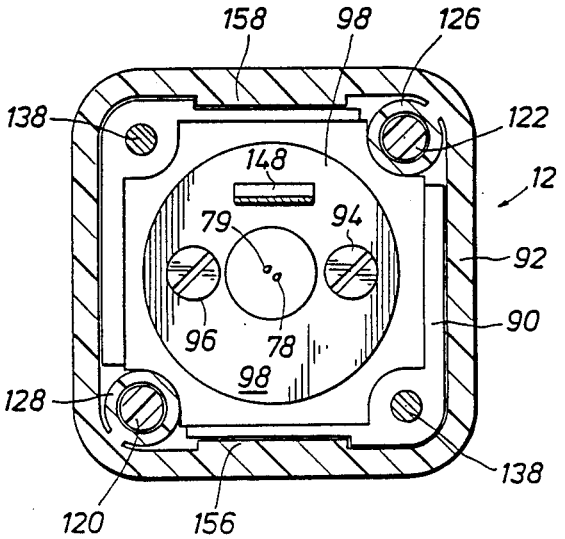
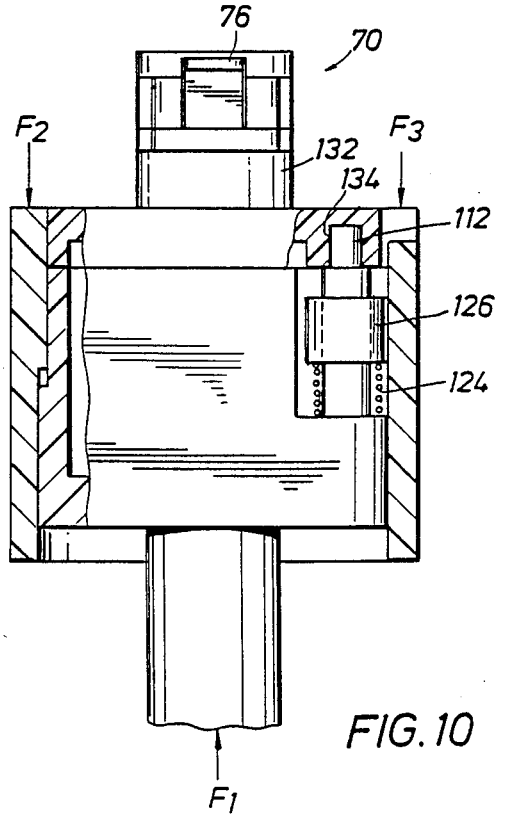
FIG.10

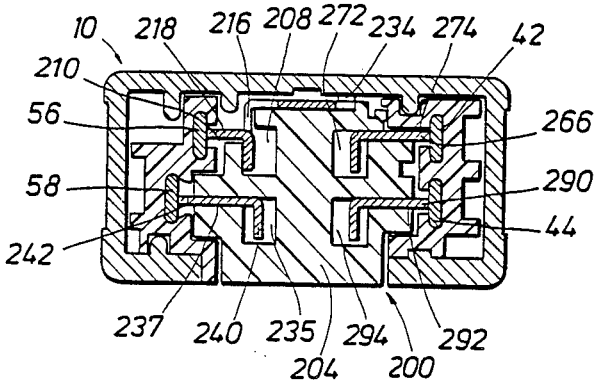
FIG. 11
FIG. 12
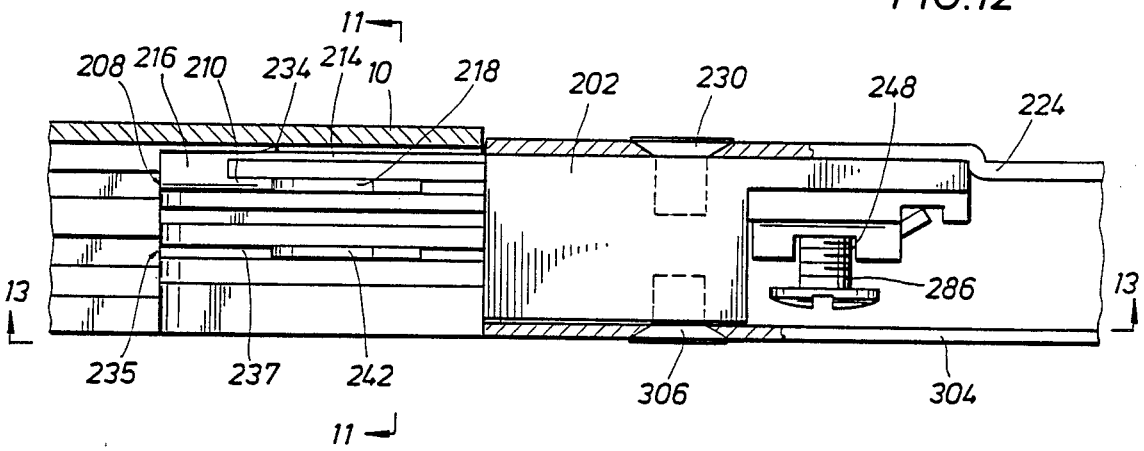
FIG. 13
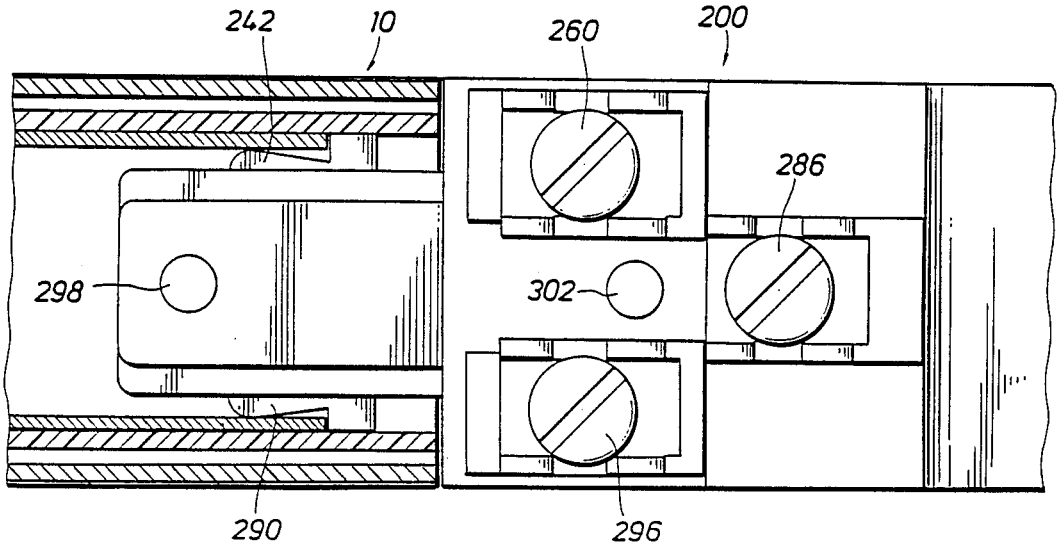

FIG. 14
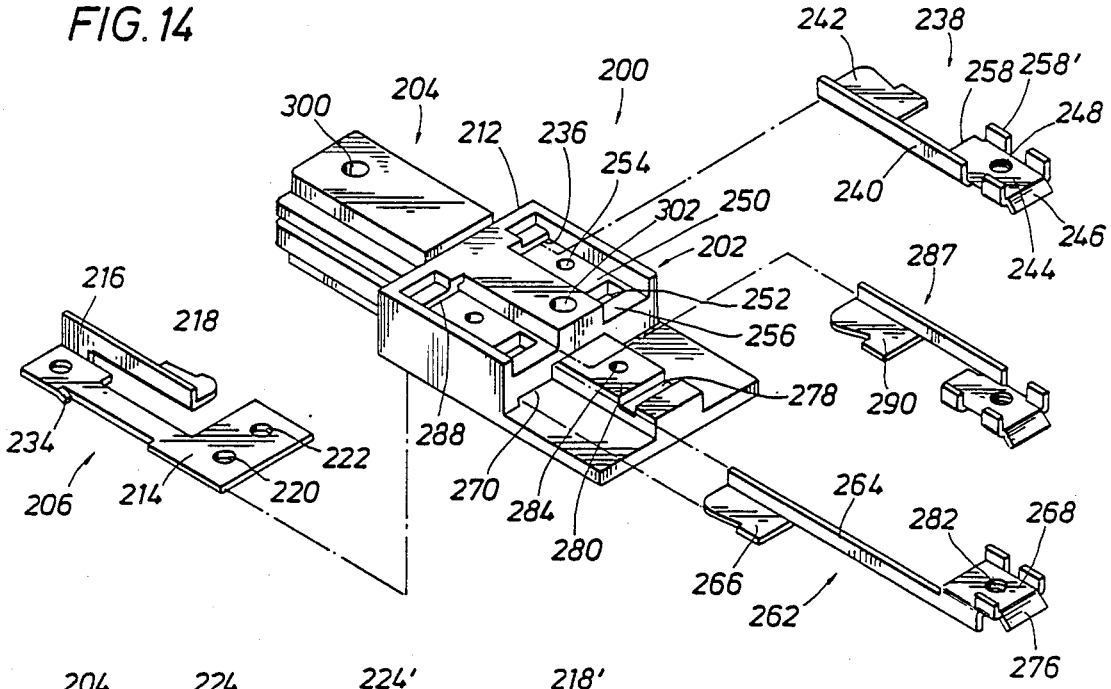
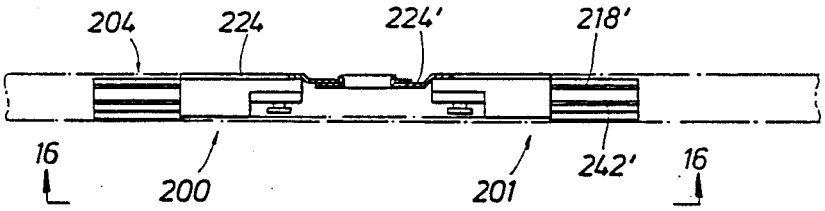
FIG. 15
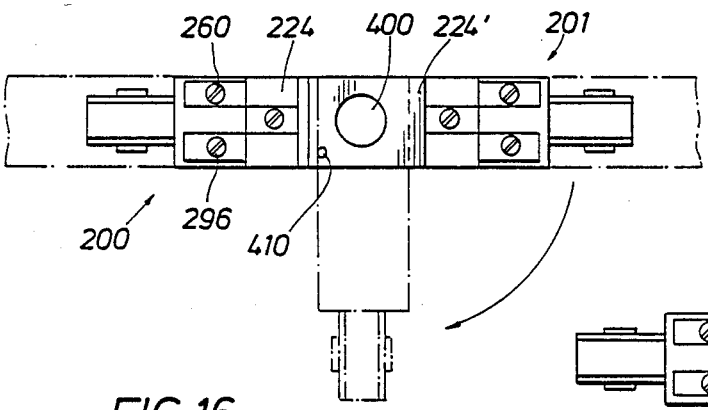
FIG. 16
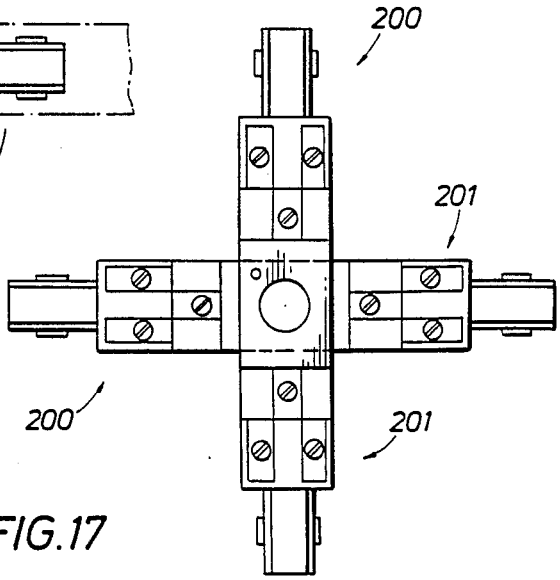
FIG. 17

TRACK LIGHTING APPARATUS

BACKGROUND OF THE INVENTION

1. Field of the Invention

This invention relates in general to the field of track lighting and in particular to track lighting apparatus carrying two independent power circuits, either one of which may be accessed by means of a plug box having a selectable contact position.

2. Description of the Prior Art

A track lighting system provides a linear power source to which lampholders may be attached at any point. A prior track lighting system has provided track sections which may be connected end-to-end or at 90° angles by means of plug connectors. Such track sections are accessed by means of plug boxes for each lamp socket to be connected to the track. Such track sections typically carry but one power circuit which may be controlled by a wall switch or a wall dimmer in a usual manner.

There has developed a need for the capability to carry two power circuits in a low profile single track section, either of which may be accessed by a single plug box with selection means allowing one or the other of the power circuits to be accessed. With such two power track lighting systems, lamps carried by individual plug boxes may be controlled via two different switches or dimmers to achieve desired lighting effects with increased flexibility over single circuit systems.

3. Identification of Objects of the Invention

It is therefore an object of the invention to provide a low profile track system carrying two power circuits, either of which may be accessed by a single plug box having a selectively positioned contact.

Another object of the invention is to provide a low profile track lighting system which is compatible with a prior art single circuit track system.

It is another object of the invention to provide a plug box adapted to access a two circuit track according to the invention, or to access a prior art single circuit track.

It is another object of the invention to provide a plug box and track section where the plug box may be rotated clockwise or counterclockwise only ninety degrees, depending upon the orientation on insertion into the track section, into contacting position within the track section such that a power contact of the plug box cannot make contact with a neutral bus of the track section and a neutral contact of the plug box cannot make contact with a power bus of the track section, thereby preventing inadvertent misconnection of the plug box to the power leads of the track section.

It is another object of the invention to provide one-way insertion of right hand and left hand connectors for connecting two or more track sections or providing feed connection to power source wiring while maintaining proper electrical polarity.

It is another object of the invention to provide contacts for modular connectors for track lighting sections which may be locked in place during connector assembly and to provide contacts for ground, neutral and voltage busses.

It is still another object of the invention to provide a support plate by which two or more track lighting modular connectors may be attached to one another with a swivel for rotating one connector with respect to another between minus ninety and plus ninety degree positions.

SUMMARY OF THE INVENTION

The objects identified above, as well as other advantages and features of the invention are incorporated in track lighting apparatus including a novel longitudinal track section carrying a neutral bus and a ground bus on one lateral side and first and second voltage busses on its other lateral side. The track includes a bottom longitudinal slot opening to a channel between the two sets of busses on opposite lateral sides. The track section has open ends on its right and left hand ends.

A plug box is provided having a contact head which has a lateral width smaller than the bottom longitudinal slot of the track section. The contact head carries on one longitudinal side neutral and ground contacts which are vertically and laterally spaced corresponding to the neutral and ground busses carried by the track section. The other longitudinal side of the contact head carries a single voltage contact which is selectively moveable between two extreme vertical positions. Each extreme vertical position corresponds to the vertical position of one of the two voltage busses carried by the track section.

The plug box is inserted into the track section slot and turned in a direction such that the neutral contact and the ground contact turn toward the respective neutral bus and ground bus while the voltage contact turns simultaneously toward one or the other of the two voltage busses of the track, depending on which extreme vertical position of the voltage contact has been selected. The contact head is constructed to have a profile defined by a longitudinal cross-section through it to cooperate with the track section lateral profile to allow the contact head to be rotated ninety degrees in only one direction—ground and neutral contacts toward ground and neutral busses and voltage contact toward voltage busses—thereby preventing the hazard of reversed polarity to lamp sockets.

Right and left hand plug connectors are provided to connect track sections together electrically or to provide power feed connection to the track from power circuits. The plug connectors include a plug head integrally formed with a plug base. The plug head and plug base, constructed of insulating material, have a plurality of inverse L shaped longitudinal channels opening to a plurality of inverse L shaped openings in the plug base. Each channel in the plug head includes a longitudinal slot in a lateral side of the plug head. An electrical connection member including a lateral connection terminal, a vertical plate, and a laterally extending contact forms an inverse L shaped member which, after insertion into a respective inverse L shaped opening during assembly, results in a lateral contact extending from the plug head which is electrically connected to a lateral terminal disposed on the plug base. A locking mechanism secures the electrical connection member to the plug base. A ground contact and lateral top connection plate is inserted via the distal end of the plug head.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIG. 3 shows a plug box having its contact head inserted into the power track section of FIG. 2 and having its ground, neutral and voltage contacts in electrical contact with ground, neutral busses and second or upper voltage bus, where the voltage contact is in an upper position;

FIG. 4 is a similar illustration to that of FIG. 3, but shows the electrical contact of the contact head in operative contact with a first or lower voltage bus;

FIG. 5 is a sectional view taken along lines 5—5 of FIG. 3 which shows operative contact of the ground contact and voltage contact with the ground bus and voltage bus of the power track section;

FIG. 6 is a view similar to that of FIG. 5, but shows the contact head after its placement in a bottom slot of the track section but before rotation into operative contact with the track section;

FIG. 7 is a sectional view taken along lines 7—7 of FIG. 3 of the plug box and its contact head above and stem below;

FIG. 8 is a view taken along lines 8—8 of FIG. 7 and shows the plug box, partially in section, from a side view which shows the voltage contact in its upper extreme position;

FIG. 9 is a view taken along lines 9—9 of FIG. 7 and shows the interior of the plug box;

FIG. 10 is a view similar to that of FIG. 8, but illustrates the forces on it as it is being inserted into a track section;

FIG. 11 is a lateral cross section view through the track section taken along the lines 11—11 of FIG. 12 and shows contacts of a plug connector in operative contact with the busses of the track section;

FIG. 12 is a side view of a plug connector inserted in the right hand end of a track section and the track section in cross section which shows ground and neutral contacts of the plug connector in operative contact with ground and neutral busses of the track section;

FIG. 13 is a bottom view taken along lines 13—13 of FIG. 12 and illustrates bottom terminal plates and terminal screws and shows the operative contact between the neutral contact of the plug connector with the neutral bus of the track section and the lower voltage contact of the plug connector with the lower voltage bus of the track section;

FIG. 14 shows an exploded view of the plug connector—turned up-side down—the view illustrating the plug head, plug base and the assembly of electrical connection members which, when assembled with the head and base each serve as terminals and contacts connected by a vertical member;

FIG. 15 shows a side view, partially in section of two track sections connected by right hand and left hand plug connectors, each connected to each other electrically by means of swivel-connected grounding/support plates;

FIG. 16 shows a bottom view as indicated by lines 16—16 of FIG. 15 which is a bottom view of two track sections connected in a straight pattern, with a phantom view where the support plates may be turned in an "L" pattern ninety degrees with respect to one another; and FIG. 17 shows a bottom view of plug connectors connected in an "X" pattern.

DESCRIPTION OF THE INVENTION

Figure 1:
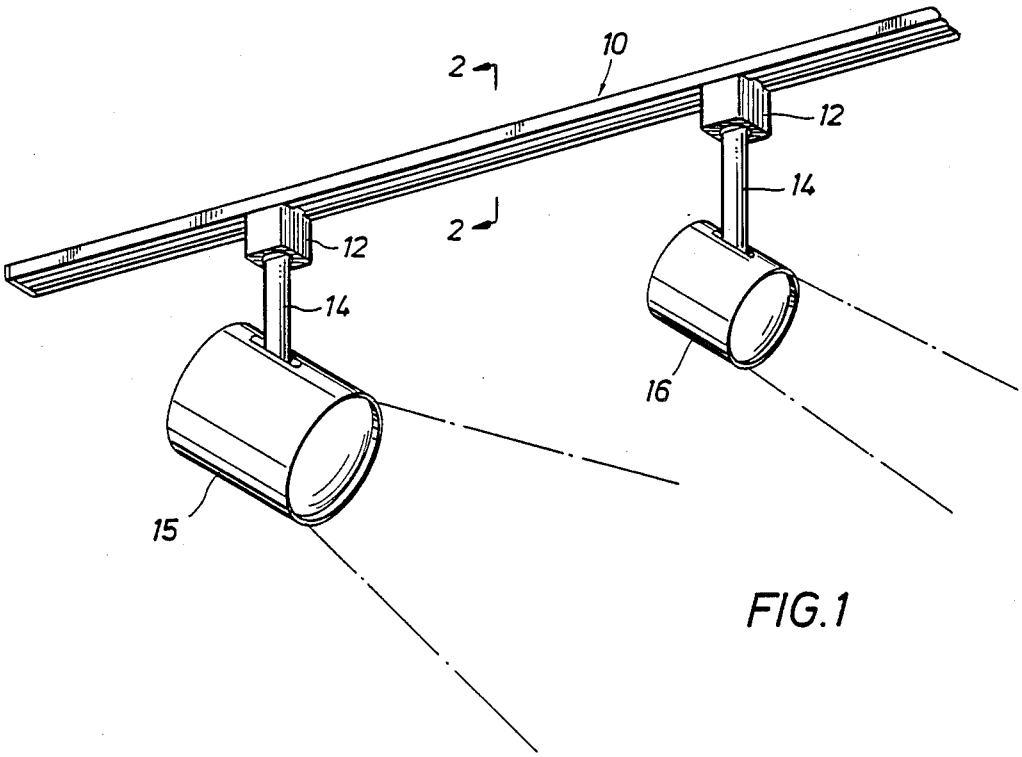
FIG. 1 is a perspective view of a track section according to the invention with two lamp sockets secured to it via two plug boxes.

FIG. 1 illustrates a track section 10 carrying first lamp socket 15 and second lamp socket 16 via respective plug boxes 12 and stems 14. As will be illustrated in the following description, first lamp socket 15 may be connected to a circuit independent of the circuit to which second lamp socket 16 is connected. Each circuit may be connected to a separate wall switch and each circuit may have a different voltage applied to it, as for example via a dimmer switch. Alternatively, first lamp socket 15 may be connected to the same circuit as that to which second lamp socket 16 is connected.

Figure 2:
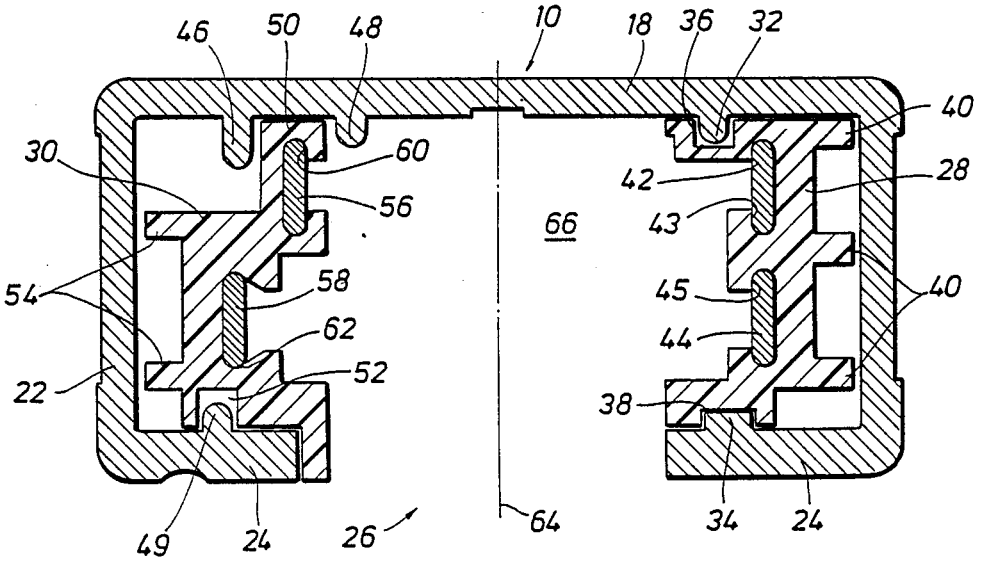
FIG. 2 is a lateral cross-section of a power track section taken along lines 2—2 of FIG. 1.

FIG. 2 illustrates the construction of track section 10 as seen in a lateral cross-sectional view. Track section 10 has a generally rectangular cross-sectional shape defined by top side 18, lateral sides 20, 22 and bottom side 24 having a slot 26 disposed therein. The track section 10 is preferably formed of aluminum.

A first bus holder 28 and second bus holder 30, each fabricated of insulating material, are disposed in the interior of track section 10 adjacent the lateral sides 20 and 22. Bus holder 28 is laterally maintained by upper and lower lips 32 and 34 about which channels 36 and 38 of bus holder 28 fit. Ridges 40 provide structural rigidity and lateral spacing to support 28 and are stopped by the interior lateral side of side 20 when a plug box or plug connector is inserted into the track section. Bus holder 28 carries upper or "second" voltage bus 42 and lower or "first" voltage bus 44 in longitudinal channels 43 and 45.

The second bus holder 30 is maintained laterally by lips 46, 48 and 49 with shoulder 50 disposed between lips 46, 48 and channel 52 of bus holder 30 disposed about lip 49. Ridges 54 provide structural rigidity and lateral spacing to bus holder 30 and are stopped by the interior lateral side of side 22 when a plug box or plug connector is inserted into the track section. Bus holder 30 carries ground bus 56 and neutral bus 58 in longitudinal channels 60 and 62.

Ground bus 56 is disposed in bus holder 30 at a closer distance to the central axis 64 of the track section 10 than is neutral bus 58. Voltage busses 42 and 44 are spaced equally from center line 64. A longitudinal channel 66 is defined in the interior of track section 10 which may be accessed by means of a plug box via slot 26 to establish a circuit between neutral bus 58 and one of the voltage busses 42,44.

FIG. 3 illustrates a plug box 12 connected via slot 26 within channel 66 of track section 10. A contact head 70 of plug box 12 has been operatively positioned within channel 66 such that its ground contact 72, its neutral contact 74 and its circuit contact 76 are in operative contact respectively with the ground bus 56, the neutral bus 58, and the upper or second voltage bus 42. The circuit contact 76 is shown in its upper position which may be selected prior to installation of the plug box 12 into channel 66 of track section 10. The neutral contact 74 and circuit contact 76 are each electrically connected to one of the leads 78, 79 which run through stem 14 and plug box 12.

FIG. 4, a similar view as that of FIG. 3, shows that circuit contact 76 may be selectively placed in a downward position such that after contact head 70 of plug box 12 has been operatively connected to track section 10 within channel 66, circuit contact 76 is electrically connected to lower voltage bus 44.

FIG. 5 illustrates in a view taken along lines 5—5 of FIG. 3 the top of contact head 70 with ground contact 72 in electrical contact with ground bus 56 and circuit contact 76 in electrical contact with upper or second voltage bus 42. FIG. 6 is a view similar to that of FIG. 5, but shows the head 70 inserted into slot 26 prior to completion of the insertion steps required to connect plug box 12 and its contact head 70 to track section 10. The view of FIG. 6 shows neutral contact 74 extending beyond ground contact 72.

The longitudinal profile of contact head 70 and the lateral profile of the channel 66 of track section 10 are cooperatively arranged to insure one-way insertion of head 70 into contacting installation, thereby assuring proper contact of the contacts of head 70 with the busses of track section 10. As FIG. 6 illustrates, proper installation of head 70 requires that it have its longitudinal profile inserted within channel 64 and then rotated ninety degrees, as indicated by arrows 80.

FIG. 6 illustrates head 70 inserted within slot 26 in an orientation such that neutral contact 74 and ground contact 72 face the top of the figure with circuit contact 76 facing the bottom of the figure. Of course head 70 can be inserted with slot 26 in an orientation 180° from that illustrated in FIG. 6. In the particular orientation of head 70 in slot 26 of FIG. 6, the directional arrows of FIG. 3 illustrate that contact head 70 and plug box 68 cannot be rotated in the clockwise direction such that the contacts of head 70 can make contact with the busses of track section 10. For example, the distance between the center-line 64 of head 70 and its longitudinal edge 82, as indicated by arrow d1, is greater than the distance as indicated by arrow d2 between the center-line 64 of head 70 and the edge 84 of insulating bus holder 28. Consequently, if head 70 were to be rotated in the clockwise direction (see FIG. 6), the edge 82 of head 70 would contact edge 84 of holder 28 and be prevented from being aligned within channel 66 for contacting of its contacts with any of the busses carried by track section 10. Similarly, the distance as indicated by arrow d3 from center line 64 to longitudinal edge 86 of head 70 is greater than the distance as indicated by arrow d4 from the center line 64 to surface 88 of insulating bus holder 30. If head 70 were to be rotated in the clockwise direction (see FIG. 6), the edge 86 of head 70 would contact edge 88 of holder 30 and be prevented from being aligned within channel 66 for contacting of its contacts with any of the busses carried by track section 10.

Similarly, if head 70 were to be inserted in an 180° different orientation from that illustrated in FIG. 6, it could not be rotated in the counterclockwise direction such that the contacts of head 70 can make contact with the busses of track section 10.

FIGS. 7–10 illustrate the components and assembly of stem 14 and plug box 12 and contact head 70. The plug box 12 includes nested cubical shaped boxes including core box 90 and sleeve box 92. Core box 90 includes hole 100 in its bottom surface which is surrounded by an annular groove 112 on its external bottom surface. A circular plate 104 having an outer annular neck 105 and annular central region 106 is inserted via the bottom of core box 90 such that neck 105 fits within groove 112 and central region 106 fits within hole 100. A washer 113 fits about the periphery of circular plate 104 on the inside of core box 90. A circular plate 98 is disposed on the top surface of circular plate 104. Stem 14 includes extruded channels 100, 102 and is secured to core box 90 by means of self threading screws 94, 96 inserted through aligned holes in annular plate 98 and circular plate 104. Aligned holes 114 and 114′ in circular plate 104 and annular plate 98 communicate with hollow region 116 for the passage of electrical leads 78, 79.

Sleeve box 92 is open at its top and bottom ends and is dimensioned to fit about the outside of core box 90. Core box 90 includes two diagonally oriented vertical pins 120, 122 which extend upwardly from its bottom surface. Pin 122 has a coiled spring 124 placed about its outer surface. Sleeve box 92 has integral cylindrical members 126, 128 secured on its inside diagonal corners, such that pins 122 and 120 are free to reciprocate therein. Pins 122 and 120 are dimensioned to extend beyond the top of cylindrical members 126 and 128. Pins 120 and 122 are preferably of different diameters. Cylindrical member 126 and 128 are of corresponding different diameters to assure proper alignment of core box 90 and sleeve box 97.

As best seen in FIGS. 7 and 8, contact head 70 includes a lateral plate 130 which carries a vertical member 132. Lateral plate 130 is dimensional to fit atop core box 90 and includes cylindrical slots 134 of different diameters in its diagonal corners dimensioned to accept pins 122 (of a first diameter) and 120 (of a second different diameter) when plate 130 is disposed on top of core box 90. Plate 130 is secured to core box 90 by means of screws 136 through holes 140 in the other two diagonal corners of plate 130. Holes 140 are placed in plate 130 to align with holes 138 in core box 90.

Vertical member 132 carries a head member 142 above and a tail member 144 below by means of a rivet or screw and nut assembly 146 extending from the top of head member 142 through aligned holes in head member 142, vertical member 132 and tail member 144. Ground contact 72 extending outwardly from head member 142 is electrically connected by means of rivet 146 to a metallic plate 148, the bottom of which contacts metallic plate 98 carried by core box 90. Since stem 14 is metallic, preferably aluminum, electrical contact is extended from stem 14 to ground contact 72. Alternatively, a ground lead may be connected to the interior head 146′ of rivet 146 and run through holes 114, 116 to ground the lamp socket attached below stem 14.

Vertical member 132 carries outwardly extending neutral contact 74 on the same longitudinal side as ground contact 72 is carried. Neutral contact 74 is embedded in vertical member 132 and terminates below plate 130 and has an angled plate 74′ about which push-on terminal connector 150 may be placed. Lead 79 is electrically connected to terminal connector 150 and runs to a light socket via stem 14.

Vertical member 132 carries outwardly extending circuit contact 76 on its other longitudinal side. Circuit contact 76 also runs through vertical members 132 to a terminal plate 76′ to which a push-on terminal connector 152 may be placed. Lead 78 is electrically connected to terminal connector 152 and also runs to a light socket (see FIG. 1) via stem 14. Circuit contact 76 is free to be moved between an upper extreme position (as illustrated in FIGS. 7, 8, 10) and a lower extreme position (as illustrated in FIG. 4). The circuit contact 76 fits within a tight channel within vertical member 132 and can best be moved vertically between upper and lower positions with the force of a flat object pushing against it with reasonable force. A flat blade screwdriver is ideal for this purpose. A vertical channel 154 disposed on a longitudinal side of head member 142 provides vertical clearance for the lateral portion of circuit contact 76 to reciprocate between upper and lower positions. The lower part 76' of circuit contact 146 is free to move up and down. There is enough slack in lead 78 within plug box 12 to follow the reciprocation of circuit contact 76.

As best seen in FIGS. 8 and 9, sleeve box 92 includes two lips 156 and 158 which extend vertically from opposite sides. The lateral width of lip 156 and of lip 158 is slightly smaller than the width of slot 26 of power track 10 (see FIG. 2).

With reference to FIGS. 8, 9 and 10, the operation of plug box 12 as it is inserted via slot 26 of power track 10 may be described. The contact head 70 is inserted via slot 26 into channel 66 of power track 10 such that lips 156 and 158 bear against outside edges of the bottom side 24 of power track 10. As illustrated in FIG. 10, the stem 14 is then manually pushed upwardly with force $F_1$ which is opposed by forces $F_2$ and $F_3$ of the bottom side 24 of power track 10 (as illustrated in FIG. 2) which causes spring 124 to be compressed as lateral plate 130 of contact head 70 and lips 156 and 158 are contacting bottom side 24. After ninety degree rotation (the direction of which is dictated by the orientation of placement of head 70 within slot 26) of stem 14 and plug box 12 (while upward force is being applied), the contacts 72, 74 and 76 contact their respective busses 56, 58 and 42 or 44 (depending on the vertical position of contact 76) and lips 156 and 158 snap into slot 26 by the force of spring 124 driving sleeve box 92 upwardly with respect to core box 90. Consequently, plug box 12 is secured within power track section 10 by the force of spring 124 and the force of contacts 72, 74, 76 to their respective busses. The plug box 12 is removed by applying sufficient downward force to sleeve box 92 to cause lips 145 and 158 to clear the bottom sides 24 of power track section, after which the stem and plug box may be rotated in the proper direction for removal.

FIGS. 11–14 illustrate plug connector 200 and its connection with power track section 10. FIG. 14 is an upside down exploded view showing the parts of plug connector 200. FIG. 12 is a side view, partially in section, of plug connector 200 inserted in one end (arbitrarily called the "right hand end") of power track section 10. FIG. 13 is a bottom view, partially in section, of plug connector 200 inserted in the right hand end of power track section 10.

As best seen in FIG. 14, plug connector 200 includes plug base 202 and plug head 204 integrally formed of insulating material. The plug connector 200 has four "inverse L" shaped channels formed in its plug head 204, three of which extend into plug base 202. The term "inverse L" describes the shape of the channel when viewed from the plug head 204 looking into the track section 10 (for example, see FIG. 11) or from the end of the plug head 204. Three of the channels may be seen from the end of the plug base 202 as in FIG. 14. Into each channel, a metallic member, preferably of an alloy of copper such as brass, is placed to form a contact, connecting member and terminal plate.

The ground member 206 is inserted within inverse L slot 208 (see FIGS. 11, 12) which has a longitudinal opening 210 running from the distal end of the plug head 204 to the wall 212 between plug base 202 and plug head 204. As best seen in FIG. 14, ground member 206 includes a top lateral or "ground" plate 214, a vertical connecting plate 216 and a lateral "ski" or ground contact 218. As seen in FIGS. 11, 12, vertical plate 216 is inserted in channel 208 of plug head 204 with "ski" or ground contact 218 disposed in lateral opening 210 and with ground member 206 disposed on a top surface of plug head and extending longitudinally to a portion of the top of plug base 202. Holes 220, 222 are provided in ground top plate so that a metallic ground/support plate 224 (see FIGS. 15, 16, 17) may be connected to it (preferably by means of rivets, not illustrated) thereby serving as an electrical ground connection. The ground-/support plate also serves to connect physically two or more plug connectors as described below. As seen in FIG. 12, a screw 230 connects support plate 224 to plug base 202.

Ground member 206 includes finger 234 which angles upwardly from plate 214. Finger 234 contacts the inner surface of power track section 10 when plug connector 200 is plugged into the end of a power track section. Finger 234 may be seen to make electrical contact with the inner edge of power track 10 in FIGS. 11 and 12.

On the same side as the channel 208 for the ground member 206, an inverse L shaped channel 235 runs from an L shaped opening 236 in plug base 202 (see FIG. 14) and continues longitudinally into plug head 204. The channel 235 has a lateral opening 237 which runs the longitudinal extent of inverse L shaped channel 235. A metallic neutral number 238 includes a vertical member 240, a laterally extending "ski" or contact 242 and a lateral terminal plate 244. The neutral member 238 is installed in plug connector 200 via inverse L shaped opening 236 with contact 242 and vertical member 240 forming a complimentary inverse L shape which snuggly fits within opening 236.

Longitudinally to adjacent opening 236 is a terminal surface 250 to the rear of which is a slot 252. A cylindrical depression 254 is disposed in terminal surface 250. The lateral terminal plate 244 is longitudinally dimensioned substantially the same as terminal surface 250 but has a forward extension 258 which extends forward from a tab 258'. An upwardly angled trailing finger 246 is integrally formed from the rear edge of terminal plate 244. As the neutral member 238 is pushed through opening 236 into channel 235, finger 246 meets the rear edge 256 of surface 250 while forward extension 258 partially fits within opening 236. With continued forward forcing of neutral number 238 into channel 235, the vertical member 240 and terminal plate 244 flex sufficiently to allow finger 246 to ride over edge 256 finally coming into locked position with finger 246 in slot 252. Forward extension 258 being placed within opening 236 assures that terminal plate lies flat against surface 250 after insertion of member 238 within channel 235. Neutral member 238 is locked into position by the cooperating effect of the finger 246 in slot 256 and the front edge of tab 258' of member 238 abutting vertical surfaces of plug base 202 which surround opening 236. Neutral contact 242 can be seen extending from opening 237 in FIGS. 11 and 12.

Hole 248 is aligned with cylindrical depression 254 in terminal surface 250 of plug base 202. Hole 248 is threaded to accept threaded terminal screw 260 as illustrated in FIGS. 12 and 13. A connecting lead (not shown) is connected to screw 260 by threading screw 260 upwardly through threaded hole 248 and aligned cylindrical depression 254 further serving to lock neutral member 238 to plug connector 200.

An upper voltage connection member 262 includes a vertical member 264, an integral "ski" or upper voltage contact 266 and lateral terminal plate 268. An inverse L shaped opening 270 is formed in the plug base 202 with an inverse L shaped channel 272 with a lateral opening 274 running longitudinally of the plug head 204. The upper voltage connection member 262 is placed in opening 270 and secured in place by means of an upward trailing finger 276 becoming trapped in slot 278 of terminal surface 280 of plug base 202. Threaded hole 282 of upper voltage connection member 262 is aligned with cylindrical depression 280 after member 262 is locked or trapped in place. A terminal threaded screw 286 is illustrated in FIG. 13 in hole 282 and into depression 284. Contact 266 may be seen in FIG. 11 extending laterally from opening 274 of inverse L shaped channel 272 while making electrical contact with upper bus 42.

Lower voltage connection member 287 is connected in a similar manner to that of neutral member 238 (including a forward extension on its terminal plate to fit within opening 288) and is inserted into inverse L shaped opening 288. Its lateral "ski" or contact 290 extends from opening 292 of inverse L shaped channel 294 running longitudinally through plug head 204 to opening 288 of plug base 202. A terminal screw 296 is provided in a similar manner as screws 286, 260. Contact 290 may be seen contacting lower voltage bus 44 in the bottom view of FIG. 13 or the lateral cross sectional view of FIG. 11.

A screw 298 provided in hole 300 in the end of the plug head 204 (see FIGS. 13, 14) serves to secure the end of ground top plate 214 of ground member 206 to the plug head 204. A hole 302 is provided in the bottom of plug base 202 to accept a self tapping screw for attaching a cover box to cover the plug base 202 after a plug connector 200 has been plugged into a power track section 10. Such a cover plate 304 is shown attached to plug base 202 by means of threaded screw 306 in FIG. 12.

Right and left hand plug connectors 200 and 201 are illustrated in FIG. 15. Right hand connector 200 is adapted to connect into the right hand end of power track section 10. Left hand plug connector 201 has its ground contact 218' and neutral contact 242' disposed on the same lateral side as the corresponding contacts of the right hand plug connector 200, but point to the right so as to plug into the left hand end of power track 10.

FIGS. 15 and 16 show support plates 224, 224' of right and left hand plug connectors 200 and 201 connected together so that right or left hand L turns may be formed. Each support plate 224 has a hole 400, which for ‡tee" shaped or "X" shaped connections, for example of FIG. 17, may be aligned and serve as an electrical conduit feed path from electrical leads in the ceiling. For the "L" turn embodiment, however, the peripherial metal surrounding the hole 400 of one support plate 224 may be forced inwardly through the hole 400 of the other support plate 224' to form a swivel by which support plate 224 may be rotated between plus and minus 90 degrees with respect to support plate 224, thereby allowing the connected support plates and plug connectors to be alternatively placed in right hand or left hand "L" shapes. A threaded hole 410 formed in support plate 224 near, but spaced from the end of overlapping support plate 224', accepts a threaded screw which may be placed therein serving to lock support plate 224' in either its right hand or left hand orientation. The screw and a locking washer in hole 410 may also be used to terminate a ground wire from a ceiling ground lead.

Various modifications and alterations in the description above will be apparent to those skilled in the art of track lighting. Such changes are desired to be included in the appended claims. The appended claims recite the only limitations to the present invention. The descriptive manner which is employed for setting forth the embodiments of the invention should be interpreted as illustrative and not limitative.

What is claimed:

1. Track lighting apparatus comprising in combination, a longitudinal track section having a body with a right end and a left end and having a lateral cross section defined by first and second lateral sides, a top side of top width and a bottom side having a slot of width smaller than said top width, said sides defining a channel within said track which is open from beneath said track via said slot, a first insulator structure disposed within said channel adjacent said first lateral side, said first insulator structure carrying a neutral bus facing inwardly of said channel at a first lateral distance from said first lateral side and carrying a ground bus facing inwardly of said channel at a second lateral distance from said first lateral side, said ground bus being vertically separated from said neutral bus, a second insulator structure disposed within said channel adjacent said second lateral side, said second insulator structure carrying vertically separated first and second voltage busses which face inwardly of said channel at substantially identical lateral distances from said second lateral side; and a plug box with a contact head having a lateral width smaller than said slot of said track and adapted for insertion into said channel of said track via said slot in said bottom side of said track section, said contact head carrying a neutral electrical contact on one longitudinal side, a voltage electrical contact on an opposite longitudinal side, and a ground electrical contact on said one longitudinal side on which said neutral electrical contact is carried, said ground electrical contact being vertically separated from said neutral electrical contact by a distance corresponding to the vertical separation between said ground bus and said neutral bus of said track section, said voltage electrical contact being moveable between a first fixed vertical position and a second fixed vertical position, the distance between said first vertical position and said second vertical position corresponding to the vertical separation of said first and second voltage busses of said track, whereby on insertion of said contact head of said plug box into said slot with longitudinal alignment of said head with said track, and after ninety degree rotation of said head within said channel such that said neutral contact and said ground contact of said head turns toward said neutral bus and said ground bus and said voltage contact turns toward said first and second voltage busses, electrical contact is established between said neutral contact of said head and said neutral bus of said track, between said ground contact of said head and said ground bus of said track, and between said voltage contact of said head and either of said first or second voltage busses of said track, depending upon whether said voltage contact is in its first fixed vertical position or its second fixed vertical position.

2. The apparatus of claim 1 further comprising plug connector means for electrically connecting said ground, neutral, and first and second voltage busses of two track sections together while simultaneously electrically connecting said ground busses to the bodies of each track section.

3. The apparatus of claim 1 wherein said first insulator structure carrying said neutral bus and said ground bus is defined by a first lateral cross section profile means, said second insulator structure carrying said first and second voltage busses are defined by a second lateral cross section profile means, and said contact head defined by a head cross sectional profile means defined by a longitudinal cross section through said head, said head profile means, said first profile means and said second profile means cooperatively dimensioned for allowing said head to rotate 90°, after insertion of said head into said slot of said track, only in a direction for establishing electrical contact of said neutral contact, said ground contact, and said voltage contact respectively with said neutral bus, said ground bus, and one of said voltage busses.

4. The apparatus of claim 1 further comprising plug connector means having a base carrying a neutral connection terminal and first and second voltage terminals, said plug connector means having a plug head carrying a neutral contact on one lateral side and first and second voltage contacts on the other lateral side, means for electrically connecting said first and second voltage terminals to said first and second voltage contacts and said neutral terminal to said neutral contact, said plug means operably connecting said neutral bus and said first and second voltage busses respectively to said neutral terminal and said first and second voltage terminals when said plug head is inserted into said channel within said track section via one of its ends.

5. The apparatus of claim 1 further comprising a plug connector including a plug base and a plug head integrally formed with said plug base, said plug connector having at least one electrical connection member extending between said plug head and said plug base, said electrical connection member including a contact disposed on a lateral side of said head and including a connection terminal disposed on a terminal surface of said plug base, whereby when said plug head is inserted into said channel within said track section via one of its ends, said contact makes electrical connection with one of said busses carried by said track and, via said electrical connection member, electrical connection is established between said connection terminal and said one of said busses.

6. The apparatus of claim 5 wherein said electrical connection member is a ground member including a ground top plate disposed on a top surface of said plug base and a ground contact operably disposed on a side of said plug connection means to contact said ground bus, said ground contact further including means for contacting said top side of said track section thereby electrically connecting said track section to said ground contact and said ground plate.

7. The apparatus of claim 5 wherein said electrical connection member is a ground connection member including a ground contact and a ground connection terminal, said plug head has a longitudinal channel open at its distal end and has a longitudinal slot in its lateral side on which said ground contact is disposed, said longitudinal slot communicating with said longitudinal channel, and said ground connection terminal of said ground connection member is a lateral plate connected to a vertical plate, thereby forming an inverse L shaped member with said ground contact extending laterally outwardly from said vertical plate, said ground member assembled with said plug head with said vertical plate disposed within said longitudinal channel of said plug head, with said ground contact extending laterally outwardly from said longitudinal slot, and with said ground connection terminal disposed on the top of said plug head and extending to the top of said base, and further comprising a support plate secured to said top of said base and electrically connected to said ground connection terminal.

8. The apparatus of claim 7 wherein said ground connection terminal includes a grounding finger extending vertically from said lateral plate, said finger adapted to contact said top side of said track section when said plug head is inserted into said channel within said track section via one of its ends.

9. The apparatus of claim 5 wherein said plug head and said plug base have at least one inverse L shaped longitudinal channel communicating with an inverse L shaped opening in said plug base, said channel in said plug head having a longitudinal slot in its lateral side from which said contact is disposed, said electrical connection member including a vertical plate with said contact extending laterally outwardly therefrom, thereby forming an inverse L shaped member, said connection member, after insertion via said inverse L shaped opening in said plug base, having said contact extending laterally outwardly from said longitudinal slot in said plug head.

10. The apparatus of claim 9 wherein said terminal surface of said plug base is adjacent said L shaped opening in said plug base, and said connection terminal of said electrical connection member includes a lateral terminal plate carried by said vertical plate, said lateral terminal plate being disposed on said terminal surface of said plug base after insertion of said electrical connection member in said L shaped opening in said plug base.

11. The apparatus of claim 10 wherein said lateral terminal plate has a front end and a back end and includes a trailing finger which bends upwardly at said back end, said terminal surface of said plug base is disposed between a forward vertical surface of said base and a rear notch, whereby upon insertion of said electrical connection member into said channel, said trailing finger is placed within said notch and said front end of said terminal plate abuts said forward vertical surface, thereby securing said member to said base.

12. The apparatus of claim 10 wherein, said lateral terminal plate has a front end, a forward extension, a back end, a vertical tab and a trailing finger which bends upwardly at said back end, said terminal surface of said plug base is disposed between a forward vertical surface of said base and a rear notch, whereby upon insertion of said electrical connection member into said channel, said forward extension partially fits with said channel, said trailing finger is placed within said notch and said tab abuts said forward vertical surface, thereby securing said member to said base while assuring that said terminal plate is held flat against said terminal surface of said plug base.

13. The apparatus of claim 11 wherein said terminal surface of said plug base includes a well between said forward vertical surface and said rear notch, and wherein said connection terminal further includes a threaded hole carried by said lateral terminal plate, and a treaded screw threadedly disposed in said hole, whereby an end of said terminal screw enters said well when said screw is moved upwardly through said threaded hole, further securing said member to said base.

14. The apparatus of claim 12 wherein said terminal surface of said plug base includes a well between said forward vertical surface and said rear notch, and wherein said connection terminal further includes a threaded hole carried by said lateral terminal plate, and a treaded screw threadedly disposed in said hole, whereby an end of said terminal screw enters said well when said screw is moved upwardly through said threaded hole, further securing said member to said base.

15. The apparatus of claim 10 wherein said at least one electrical connection member and said at least one inverse L shaped longitudinal channel within said plug head and said plug base define any one of three electrical connection members including neutral, first voltage, and second voltage connection member and respectively any one of three inverse L shaped longitudinal channels including neutral, first voltage, and second voltage inverse L shaped longitudinal channels, said first voltage and said second voltage inverse L shaped longitudinal channels being disposed vertically one above the other on the same lateral side of said plug head, said neutral inverse L shaped channel being disposed on an opposite lateral side from said voltage channels, whereby when said plug head is inserted into said channel within said track section via one of its ends, said contacts of said neutral, first voltage, and second voltage connection members make electrical connection with said neutral bus, said first voltage bus and said second voltage bus of said track section and via said connection members to said neutral terminal, said first voltage terminal and to said second voltage terminal.

16. The apparatus of claim 15 having an additional electrical connection member comprising a ground connection member including a ground contact linked to a ground connection terminal by a vertical plate, said ground connection terminal being laterally connected to the top of said vertical plate thereby forming an inverse L shaped member with said ground contact extending laterally outwardly from said vertical plate at a position below said ground connection terminal, said plug head having a longitudinal channel open at its distal end and having a longitudinal slot in its lateral side on which said ground contact is disposed, said longitudinal slot communicating with said longitudinal channel, said ground connection member being assembled with said plug head with said vertical plate disposed within said longitudinal channel of said plug head, with said ground contact extending laterally outwardly from said longitudinal slot and with said ground terminal disposed on top of said base, and further comprising a support plate secured to said top of said base and electrically connected to said ground connection terminal.

17. The apparatus of claim 16 wherein said ground bus is disposed at a second lateral distance from said first lateral side of said track section, said second lateral distance being different from said first lateral distance of said neutral bus, said difference in lateral distances defining a separation distance, and wherein said plug head is a right hand plug head adapted to plug only into the right hand end of said track section and defined by said first and second voltage contacts being disposed on the lateral side of said plug which faces said second lateral side of the right hand end of said track section and said neutral and ground contacts are disposed on the lateral side of said plug head which faces said first lateral side of the right hand end of said track section, said neutral and ground contacts being laterally separated by a distance substantially the same as said separation distance.

18. The apparatus of claim 16 wherein said ground bus is disposed at a second lateral distance from said first lateral side of said track section, said second lateral distance being different from said first lateral distance of said neutral bus, said difference in lateral distances defining a separation distance, and wherein said plug head is a left hand plug head adapted to plug only into the left hand end of said track section and defined by said first and second voltage contacts being disposed on the lateral side of said plug which faces said second lateral side of the left hand end of said track section, said neutral and ground contacts being laterally separated by a distance substantially the same as said separation distance.

19. The apparatus of claims 16 wherein said support plate secured to said top of said base of said plug connector includes means for rotatingly connecting a second support plate.

20. The apparatus of claim 16 further comprising means for attaching said support plate of said connection plug to a similar support plate of a second connection plug.

21. The apparatus of claim 16 further comprising a single metallic member acting as a support plate for said connection plug at one end and as a support plate for a second connection plug at the other end.

22. The apparatus of claim 20 wherein said attaching means includes a swivel between said support plate of said connection plug and a similar support plate of a second connection plug by which said second connection plug may be turned to plus or minus ninety degrees with respect to said connection plug.

23. The apparatus of claim 22 wherein each of said support plates have an end region having a circular hole formed therein, and said swivel includes the metal on one support plate being forced through and around the hole formed in the other support plate.

24. The apparatus of claim 22 further comprising grounding terminal means disposed on one of said support plates for providing a means for electrically connecting a grounding wire to said support plate and for locking the orientation of one support plate with respect to the other.

25. A contact head of a plug box adapted for use with track lighting apparatus comprising, an insulating structure having vertical, longitudinal and lateral dimensions defining a contact head lateral cross-section profile, a neutral electrical contact means and a ground electrical contact means carried on one longitudinal side of said structure, and a voltage electrical contact means carried on an opposite longitudinal side of said structure, said voltage electrical contact means being frictionally secured within said structure, yet movable between a first fixed vertical position and a second fixed vertical position, said neutral contact means, said ground contact means and said voltage contact means for establishing electrical connection with a neutral bus, a ground bus, and one of two voltage busses carried by a longitudinal track lighting section defined by a track lateral cross-section profile, wherein said contact head lateral cross-section profile and said track lateral cross section profile are cooperatively dimensioned to prevent said neutral contact means and said voltage contact means of said contact head structure respectively contacting said either of said two voltage busses and said neutral bus of said track lighting section.

26. A low profile track lighting section comprising;

a metallic body having a lateral cross-section defined by first and second lateral sides, a top side of top width and a bottom said having a slot of width smaller than said top width, said sides defining a channel within said track which is open from beneath said track via said slot, a first insulator structure disposed within said channel adjacent said first lateral side, said first insulator structure carrying ground and neutral busses vertically spaced at first and second distances from said top side of said body, a second insulator structure disposed within said channel adjacent said second lateral side, said second insulator structure carrying first and second voltage busses which are vertically spaced from said top side of said body substantially the same as said ground and neutral busses in said first insulator structure are spaced from said top side of said body.

27. A plug connector adapted to electrically connect to a longitudinal track lighting section including a metallic track carrying a ground bus insulated from said metallic track, said plug connector comprising, a structure of insulating material including a plug base and a plug head means integrally formed with said plug base, said plug head means having longitudinal, lateral and vertical dimensions, said structure having at least one electrical connection member extending between said plug head and said plug base, said electrical connection member including a contact disposed on a lateral side of said head and including a connection terminal disposed on a terminal surface of said plug base, said electrical connection member being a ground member including a ground top plate disposed on contiguous top surfaces of said plug base, and said plug head, a ground contact disposed on a lateral side of said plug head, and a grounding finger extending vertically from said ground top plate, said plug head means for electrically connecting said ground bus of said tracking lighting section to said ground top plate and said metallic track structure via said ground contact of said plug head.

28. The plug connector of claim 27 wherein said plug head means has a longitudinal channel open at its distal end and has a longitudinal slot in its lateral side on which said ground contact is disposed, said longitudinal slot communicating with said longitudinal channel, and said ground top plate is a lateral plate connected to a vertical plate thereby forming an inverse L shaped member with said ground contact extending laterally outwardly from said vertical plate, said ground member being assembled with said plug head with said vertical plate disposed within said longitudinal channel of said plug head means, and with said ground contact extending laterally outwardly from said longitudinal slot, and further comprising a support plate secured to said top of said base and electrically connected to said ground top plate.

29. A plug connector adopted to electrically connect to a longitudinal track lighting section comprising, a plug connector including a plug base and a plug head integrally formed with said plug base, said plug connector having at least one electrical connection member extending between said plug head and said plug base, said electrical connection member including a contact disposed on a lateral side of said head and including a connection terminal disposed on a terminal surface of said plug base, wherein said plug head and said plug base have at least one inverse L shaped longitudinal channel communicating with an inverse L shaped opening in said plug base, said channel in said plug head having a longitudinal slot in its lateral side from which said contact is disposed, said electrical connection member including a vertical plate with said contact extending laterally outwardly therefrom, thereby forming an inverse L shaped member, said connection member, after insertion via said inverse L shaped opening in said plug base, having said contact extending laterally outwardly from said longitudinal slot in said plug head.

30. The plug connector of claim 29 wherein said terminal surface of said plug base is adjacent said L shaped opening in said plug base, and said connection terminal of said electrical connection member includes a lateral terminal plate carried by said vertical plate, said lateral terminal plate being disposed on said terminal surface of said plug base after insertion of said electrical connection member in said L shaped opening in said plug base.

31. The plug connector of claim 30 wherein said lateral terminal plate has a front end and a back end and includes a rigid trailing finger which bends upwardly at said back end, said terminal surface of said plug base is disposed between a forward vertical surface of said base and a rear upwardly disposed notch, whereby upon insertion of said electrical connection member into said channel, said trailing finger is placed within said notch and said front end of said terminal plate abuts said forward vertical surface, thereby securing said member to said base.

32. The plug connector of claim 31 wherein said terminal surface of said plug base includes a well between said forward vertical surface and said rear notch, and wherein said connection terminal further includes a threaded hole carried by said lateral terminal plate, and a treaded screw threadedly disposed in said hole, whereby an end of said terminal screw enters said well when said screw is moved upwardly through said threaded hole, further securing said member to said base.

33. The plug connector of claim 32 wherein said at least one electrical connection member and said at least one inverse L shaped longitudinal channel within said plug head and said plug base define any one of three electrical connection members including neutral, first voltage, and second voltage connection member and any one of three inverse L shaped longitudinal channels including neutral, first voltage, and second voltage inverse L shaped longitudinal channels, said first voltage and said second voltage inverse L shaped longitudinal channels being disposed vertically one above the other on the same lateral side of said plug head, said neutral inverse L shaped channel being disposed on an opposite lateral side from said voltage channels.

34. The plug connector of claim 33 having a ground connection member including a ground contact linked to a ground connection terminal by a vertical plate, said ground connection terminal being laterally connected to the top of said vertical plate thereby forming an inverse L shaped member with said ground contact extending laterally outwardly from said vertical plate at a position below said ground connection terminal, said plug head having a longitudinal channel open at its distal end and having a longitudinal slot in its lateral side on which said ground contact is disposed, said longitudinal slot communicating with said longitudinal channel, said ground connection member being assembled with said plug head with said vertical plate disposed within said longitudinal channel of said plug head, with said ground contact extending laterally outwardly from said longitudinal slot and with said ground terminal disposed on top of said base, and further comprising a support plate secured to said top of said base and electrically connected to said ground connection terminal.

35. The plug connector of 34 wherein said ground bus is disposed at a second lateral distance from said first lateral side of said track section, said second lateral distance being different from said first lateral distance of said neutral bus, said difference in lateral distances defining a separation distance, and wherein said plug head is a right hand plug head adapted to plug only into the right hand end of said track section and defined by said first and second voltage contacts being disposed on the lateral side of said plug which faces said second lateral side of the right hand end of said track section.

36. The plug connector of claim 35 wherein said ground bus is disposed at a second lateral distance from said first lateral side of said track section, said second lateral distance being different from said first lateral distance of said neutral bus, said difference in lateral distances defining a separation distance, and wherein said plug head is a left hand plug head adapted to plug only into the left hand end of said track section.

37. The plug connector of claim 36 further comprising means for attaching said support plate of said connection plug to a similar support plate of a second connection plug.

38. The plug connector of claim 36 further comprising is said single metallic member acting as a support plate for said connection plug at one end and as a support plate for a second connection plug at the other end.

39. The plug connector of claim 37 wherein said attaching means includes a swivel between said support plate of said connection plug and a similar support plate of a second connection plug by which said second connection plug may be orientated at plus or minus ninety degrees with respect to said connection plug.

40. The plug connector of claim 39 wherein each of said support plates have an end region having a circular hole formed therein, and said swivel includes the metal on one support plate being forced through and around the hole formed in the other support plate.

41. The plug connector of claim 39 further comprising grounding terminal means disposed on one of said support plates for providing a means for electrically connecting a grounding wire to said support plate and for locking the orientation of one support plate with respect to the other.

* * * * *